United States Patent [19]

MacBain et al.

[11] Patent Number: 4,605,381

[45] Date of Patent: Aug. 12, 1986

[54] ANIMATED FIGURE TOY HAVING A UNITARY, MULTIPLE-FUNCTION SPRING

[75] Inventors: Ronald H. MacBain, Los Angeles; Tony Rhodes, Torrance, both of Calif.

[73] Assignee: Mattel, Inc., Hawthorne, Calif.

[21] Appl. No.: 566,742

[22] Filed: Dec. 29, 1983

[51] Int. Cl.[4] ..... A63H 3/12

[52] U.S. Cl. ..... 446/321

[58] Field of Search ..... 446/4, 6, 321, 330, 446/334, 333, 336, 337, 338, 339, 340, 465, 470, 431

[56] References Cited

U.S. PATENT DOCUMENTS

| | | | |
|---|---|---|---|
| 2,584,798 | 2/1952 | Goerditz | 446/321 |
| 2,942,377 | 1/1960 | Beebe | 46/119 |
| 3,425,153 | 2/1969 | Bonanno et al. | 46/119 |
| 3,830,012 | 8/1974 | Franke | 446/321 |
| 3,906,661 | 9/1975 | Weiser | 46/119 |
| 4,030,239 | 6/1977 | White et al. | 446/321 |
| 4,508,521 | 4/1985 | Klimpert et al. | 446/486 |
| 4,565,537 | 1/1986 | Klimpert et al. | 446/321 |

*Primary Examiner*—Mickey Yu

*Attorney, Agent, or Firm*—Ronald Goldman; Melvin A. Klein; Daniel Sullivan

[57] ABSTRACT

An animated figure toy (10) of the type which includes an upper torso (12) having a chest drum (14) rotatably mounted in a chest opening (18) for sequential rotation to expose an undamaged section (58), a single damaged section (60) and a double damaged section (62) is provided with an improved multiple-force spring (74). Chest drum (14) may be molded from suitable polymeric materials and includes a cam follower (45), an axle (38), a spring stop (56) and drum stops (48, 50 and 52), all of which may be formed as a unitary structure during the molding operation.

1 Claim, 6 Drawing Figures

10
36
32
12
80
16
74
76
56
46
82
45
2
2
70
54
78
55
58
38
84
18
14
30
34

ANIMATED FIGURE TOY HAVING A UNITARY, MULTIPLE-FUNCTION SPRING

DESCRIPTION

1. Technical Field

The present invention relates to animated figure toys and, more particularly, to a new and useful animated figure toy having a unitary, multiple-function spring.

2. Background Art

The prior art, U.S. Pat. No. 2,942,377, discloses a figure toy comprising a doll having an articulated arm to which a mechanism is attached for imparting movement to the arm by pressing the doll body. The arrangement of the mechanism is such that the arm will automatically return to the upwardly-directed relation upon the release of the pressure on the doll body. The mechanism includes a coil compression spring which biases a shaft axially outwardly and a torsion spring which is anchored at one end, encompasses the shaft and is anchored at its other end to a down-turned inner end of the shaft to normally retain the down-turned end of the shaft against the forward wall of the body.

Additionally, U.S. Pat. No. 3,425,153 discloses an animated figure toy having a passage-way for accommodating a cylindrical housing. A rotatable spindle within the housing carries an arm of the figure toy on one end and is constantly urged toward one extreme position by a spring. The rotatable spindle may be latched in another extreme position, and may be unlatched via a trigger which is depressed by applying pressure to the figure toy body. The trigger is located within a cavity in the housing, is biased outwardly by a compression spring and does not project beyond the cylindrical countour of the housing.

U.S. Pat. No. 3,906,661 discloses a figure toy having one moveable arm adapted to be moved automatically in a rapid downward chopping motion, and a moveable leg adapted to be moved automatically in a downward and upward kicking motion. The arm is manually set in a raised position and is held cocked in such raised position under the tension of a spring by means of a ratchet mechanism. Depression of an actuating button on the figure toy body releases the ratchet mechanism to cause the downward chopping motion of the arm by force of the spring. The leg is similarly manually set in a rearwardly elevated position under tension of the same spring by means of another ratchet mechanism which is released by depression of a second actuating button to cause the kicking motion of the leg. The ratchet mechanisms are controlled by a leaf spring which is released by the actuating buttons.

CROSS-REFERENCE TO RELATED APPLICATIONS

The animated figure toy of the present invention constitutes an improvement over the animated figure toy disclosed in co-pending application Ser. No. 533,354, which was filed Sept. 19, 1983, and which is held by the licensor of Applicant's assignee.

DISCLOSURE OF INVENTION

In accordance with the present invention, a new and useful animated figure toy is provided with a unitary, multiple-function spring. The figure toy includes a body having a moveable part including at least first and second sections; the first section represents one appearance and the second section represents another appearance.

The figure toy includes a positioning mechanism for selectively exposing one section and obscuring the other section and moving the part to expose the other section while obscuring the one section in response to an impact upon the part. The positioning mechanism includes a unitary, multiple-function spring for urging a releaseable latch mechanism into engagement, thereby securing the part in a cocked position, and for simultaneously urging the part to a released position.

BRIEF DESCRIPTION OF THE DRAWINGS

Details of the present invention will be described in connection with the accompanying drawings wherein:

FIG. 2-A is an enlarged, exploded perspective view of the internal mechanism;

FIG. 3-A is an exploded perspective view similar to FIG. 2-A, but showing the parts in a different operative position;

BEST MODE FOR CARRYING OUT THE INVENTION

Figure 1:
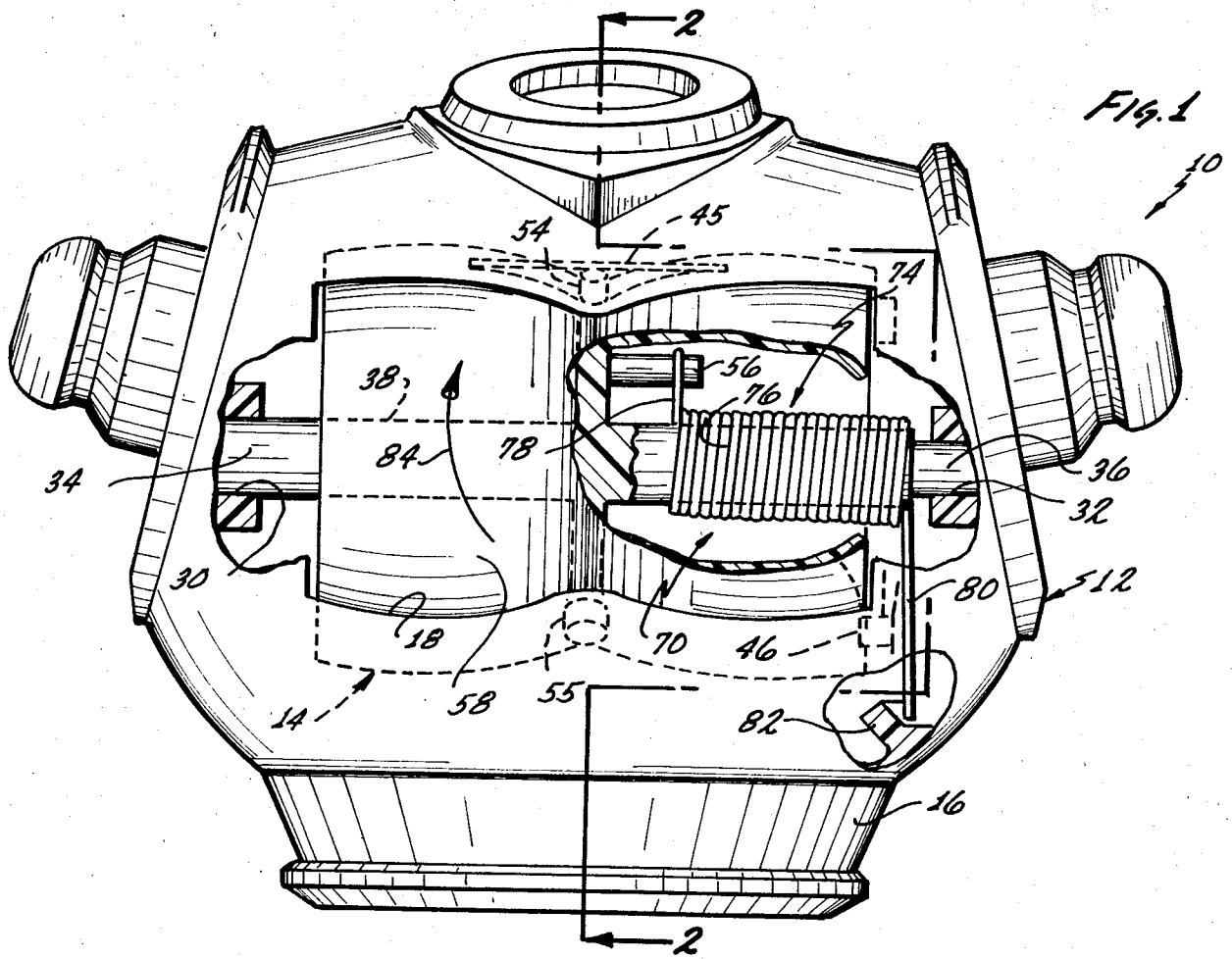
FIG. 1 is a front elevational view, with parts broken away to show internal construction, of the upper-torso portion of an animated figure toy constituting a presently-preferred embodiment of the invention.
Figure 2A:
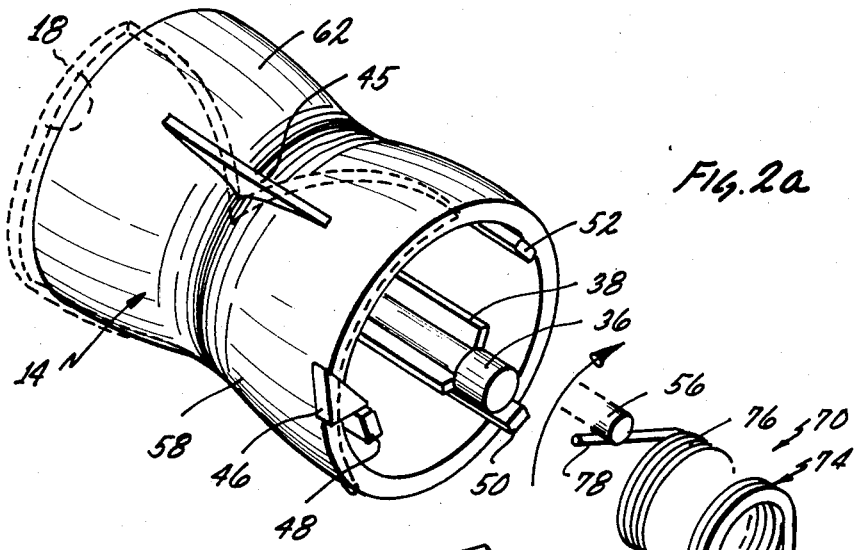
FIG. 2 is a cross-sectional view taken along line 2—2 of FIG. 1.
Figure 2:
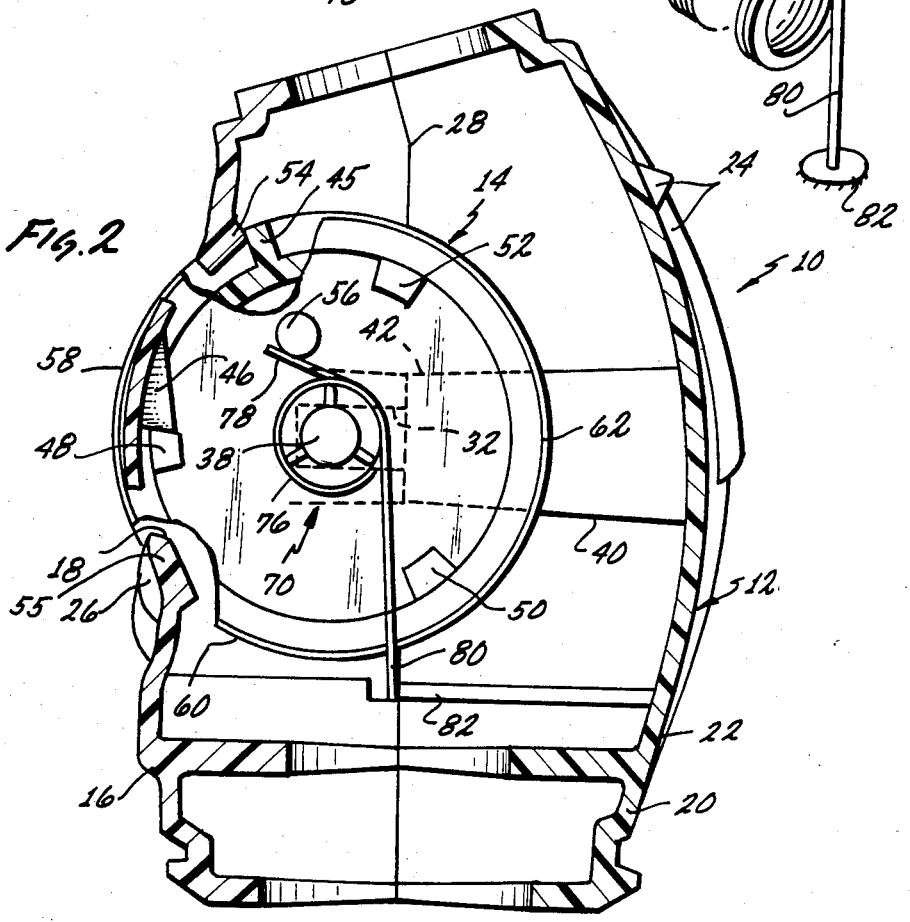

Referring again to the drawings, and more particularly to FIGS. 1 and 2, an animated figure toy constituting a presently-preferred embodiment of the invention, generally designated 10, includes an upper torso or body 12 having a moveable part or chest drum 14 rotatably mounted therein. Body 12 includes a front torso portion 16, which has a chest opening 18 provided therein, and a rear torso portion 20, which has a rear surface 22 suitably decorated with simulated armor plate 24. The front torso portion 16 may also be decorated with simulated armor plate 26. The front torso portion 16 and the rear torso portion 20 may each be molded from a suitable polymeric material and may be joined together along a parting line 28 by suitable adhesives or pin-and-socket connectors (not shown).

Molded integrally with the front torso portion 16 are a pair of slots 30, 32 (FIG. 1) in which the stub ends 34, 36, respectively, of a drum shaft or axle 38 are rotatably mounted. The rear torso portion 20 carries a pair of spaced-apart standing ribs, like the one shown at 40 in FIGS. 2 and 3, each having a free end 42 closing an associated one of the slots 30, 32. A stop member 46 is formed integrally with the inner-surface portion of the front torso portion 16 and is adapted to be engaged sequentially by fixed stop members 48, 50, 52 projecting from and uniformly spaced about one end of drum 14.

A transverse rib 45, which is provided on the outer surface of chest drum 14, is adapted to engage a stop 54, which is provided on the inner surface of front torso portion 16 adjacent the upper, mid portion of chest opening 18, and a stop 55, which is provided on the inner surface of front torso portion 16 adjacent the lower, mid-portion of chest opening 18.

The moveable body part 14 may be molded from a suitable polymeric material and the axle 38, stops 48, 50, 52, a spring stop 56 and rib 45 may be formed integrally therewith during a molding operation.

Referring now to FIGS. 2-A, 3-A and 4, drum 14 may be divided into a first section 58 (FIG. 2-A) which simulates an undamaged armor section in the chest area of the figure toy, a second section 60 (FIG. 3-A) simulating a first damaged section of armor having a single damaged area 61 and a third section 62 simulating a damaged section of armor having two damaged areas 64, 66.

Figure 3:
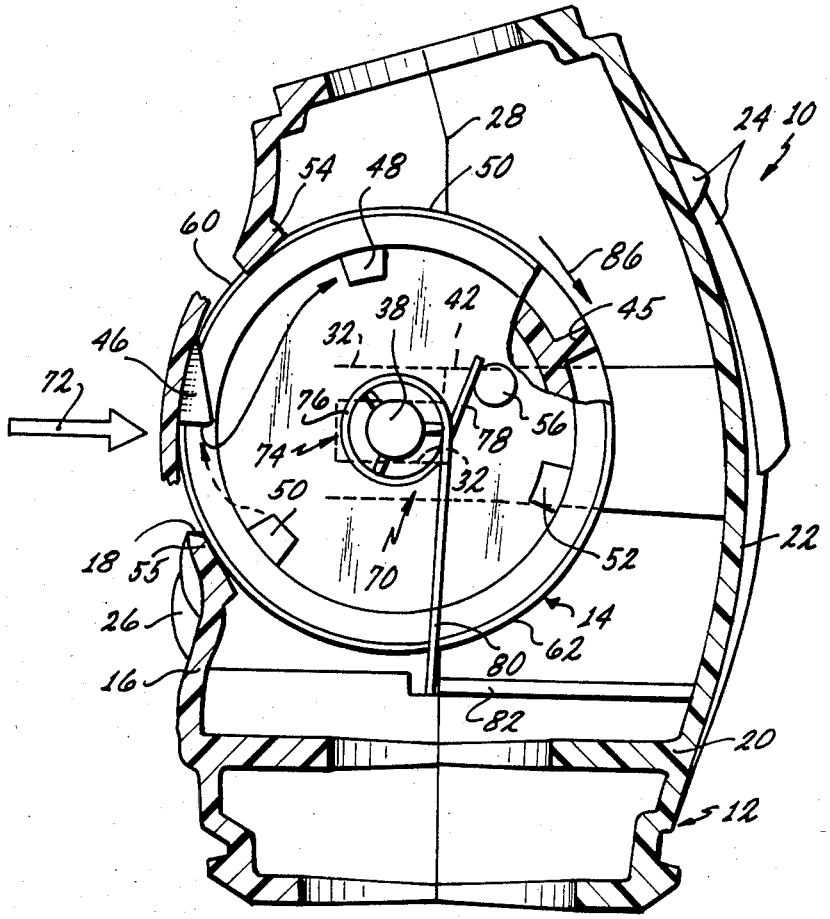
FIG. 3 is a view similar to FIG. 2, but showing the internal mechanism in a different operative position.
Figure 3A:
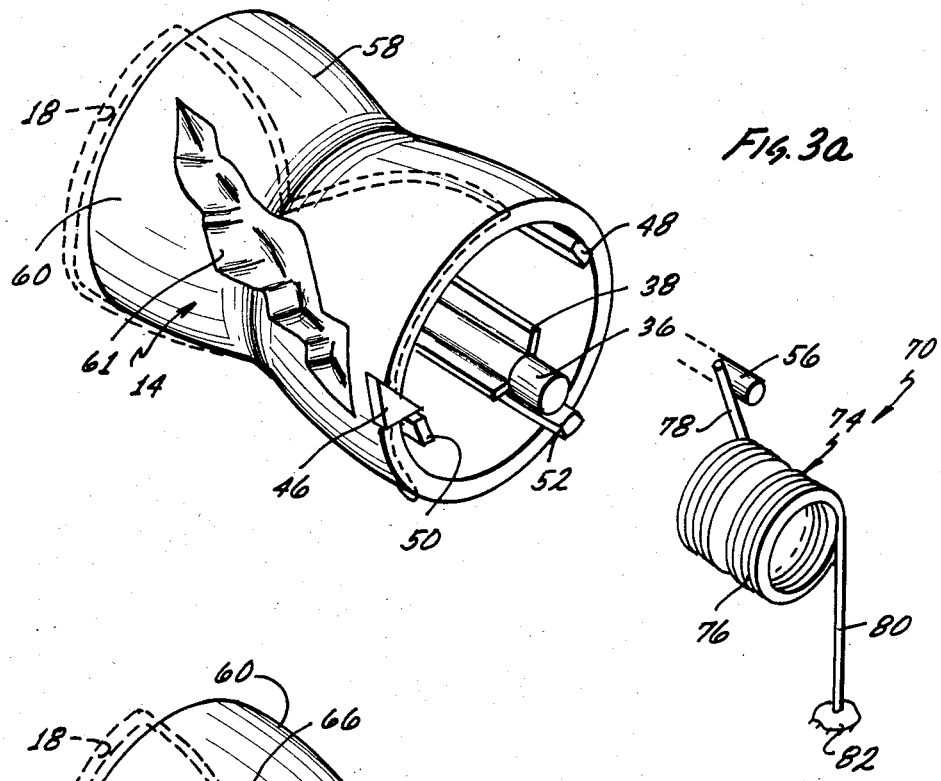
Figure 4:
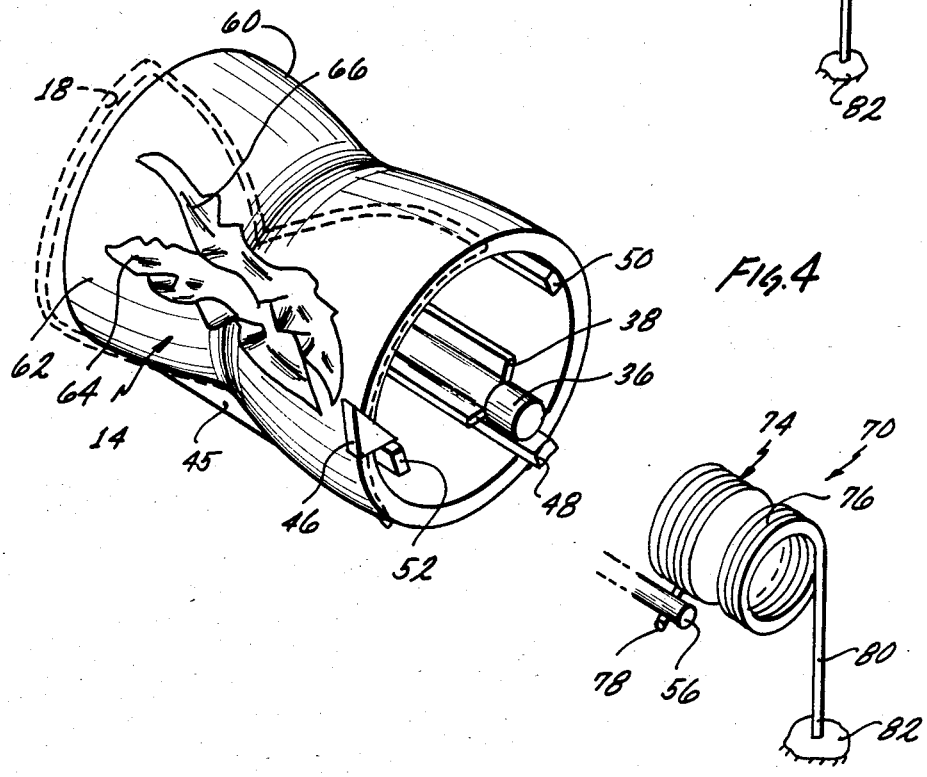
FIG. 4 is another exploded perspective view similar to FIG. 2-A, but showing the parts in a third operative position.

Referring now to FIGS. 1–4, figure toy 10 includes a positioning mechanism 70 for selectively exposing one of the sections 58, 60 or 62 and obscuring the other sections and for moving body part 14 to sequentially expose the other sections while obscuring the unexposed sections in response to impact upon the moveable body part by a simulated sword or the like, indicated schematically at 72 in FIG. 3. Positioning mechanism 70 includes a unitary, multiple-function spring 74 including a coiled body portion 76, which encompasses drum shaft 38, a short leg 78 and a long leg 80. Short leg 78 bears against the spring stop 56 and the long leg 80 bears against a spring stop 82, which is provided in rear torso portion 20. The coiled body portion 76 of spring 74 constitutes biasing means urging the moveable body part 14 to a released position and the long leg 80 constitutes a biasing force normally urging chest drum 14 into a releaseable latching condition wherein one of the drum stops 48, 50 or 52 engages a stop 46. Thus, slots 30, 32 and stops 46, 48, 50 and 52 comprise releaseable latch means securing moveable body part 14 in a cocked position.

Operation of the animated figure toy of the present invention is believed to be apparent from the foregoing and will be briefly summarized at this point. Referring to FIGS. 1 and 2, spring 74 has been loaded and chest drum 14 has been cocked by manually rotating chest drum 14 in a direction opposite to that shown by arrow 84 in FIG. 1 until the undamaged portion 58 is brought into position in opening 18 in body 12. Stop 48 on drum 14 engages fixed stop 46, which is provided on body 12 adjacent chest opening 18. Stops 46, 48 hold drum 14 in a cocked position until a force 72 (FIG. 3) engages undamaged portion 58 and moves stub ends 34, 36 of drum shaft 38 rearwardly in slots 30, 32 sufficiently to release stop 48 from engagement with stop 46. As indicated in FIG. 3, drum 14 will rotate clockwise in the direction of arrow 86 until spring leg 80 moves drum 14 forwardly and stop member 50 engages stop member 46 to prevent further rotation of drum 14. Section 60 of drum 14 with the single damaged area 61 will then be positioned in opening 18. When force 72 is applied to section 60 of drum 14, drum 14 will again be moved rearwardly until stop 50 disengages from fixed stop 46 permitting spring 74 to again rotate drum 14 clockwise until stop member 52 engages fixed stop 46 to arrest drum 14 with the double-damaged section 62 in view in opening 18. Spring 74 may be loaded again by reversely rotating drum 14 until the undamaged section 58 is positioned in opening 18.

While the particular animated figure toy herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims.

We claim:

1. In combination with an animated toy having a body including an upper torso with a predetermined opening formed therein, a rotatable chest drum positioned adjacent to said opening within said body, said drum having at least first and second sections, said first section representing one appearance and said second section representing another appearance, said rotatable chest drum including an axle rotatably mounting said drum in slots in said body, spring means including a coiled spring encompassing said axle and having a short leg portion bearing against a stop adjacent said axle and a long leg portion bearing against said body for biasing said rotatable chest drum into engagement with latch means, said latch means for positioning said first and second sections in first and second positions, said latch means including at least two stop members positioned at predetermined locations on said chest drum and a stop member on said body, said first section being exposed through said opening and said second section being concealed inside said body while in said first position, said first and second sections capable of moving from said first position to said second position due to and after impact of a force upon said chest drum which causes said axle to be displaced releasing said latch means and causing said chest drum to rotate about a longitudinal axis due to action of said coiled spring until said first and second sections are positioned in said second position by said latch means, said first section being concealed inside said body and said second section being exposed through said opening while in said second position.

* * * * *